US006402162B1

(12) United States Patent
Chiang

(10) Patent No.: US 6,402,162 B1
(45) Date of Patent: Jun. 11, 2002

(54) DUAL-PURPOSE ROLLER SKATE

(75) Inventor: Chun-Pao Chiang, Taipei Hsien (TW)

(73) Assignee: Hui-Chung Liang, Chang Hua Hsien (TW)

( * ) Notice: Subject to any disclaimer, the term of this patent is extended or adjusted under 35 U.S.C. 154(b) by 0 days.

(21) Appl. No.: 09/840,079

(22) Filed: Apr. 24, 2001

(51) Int. Cl.[7] ..... A63C 17/04

(52) U.S. Cl. ..... 280/11.233; 280/11.25; 280/11.221; 280/11.19

(58) Field of Search ..... 280/11.233, 11.221, 280/11.223, 11.19, 11.26, 11.25; 36/115

(56) References Cited

U.S. PATENT DOCUMENTS 2,095,942 A * 1/1937 Wetterstrand ..... 280/11.227
3,884,485 A * 5/1975 Walle ..... 280/841
3,979,842 A * 9/1976 Texidor ..... 280/11.19
3,983,643 A * 10/1976 Schreyer et al. ..... 280/11.19
4,333,249 A * 6/1982 Schaefer ..... 280/11.19
5,785,327 A * 7/1998 Gallant ..... 280/11.233
5,797,609 A * 8/1998 Fichepain ..... 280/11.19
6,120,039 A * 9/2000 Clementi ..... 280/11.19
6,247,708 B1 * 6/2001 Hsu ..... 280/11.223
6,308,964 B1 * 10/2001 Chang ..... 280/11.19
6,328,318 B1 * 12/2001 Hsu ..... 280/11.223
6,336,644 B1 * 1/2002 Chu

* cited by examiner

*Primary Examiner*—Robert P. Olszewski
*Assistant Examiner*—James S. McClellan
(74) *Attorney, Agent, or Firm*—Birch, Stewart, Kolasch & Birch, LLP

(57) ABSTRACT

A dual-purpose roller skate includes a sole provided with front and rear open-bottomed cavities and two wheel units separately fixedly mounted in the two cavities. Each of the wheel units mainly includes a base fixedly mounted to a top of the cavity, a wheel support pivotally connected to the base and being normally pushed downward by a first torsion spring, a wheel rotatably connected to the wheel support, and a stop arm pivotally connected at an end to one side of the base and having a bent free end normally pushed by a second torsion spring into engagement with a slot provided on the base. The bent end of the stop arm projected into the slot is also adapted to detachably engage with either a top or a lateral notch provided on the wheel support. By engaging the bent end of the stop arm with the top notch, the wheel unit is held in a lowered position to enable the dual-purpose roller skate to function like a normal roller skate for skating, and by engaging the bent end of the stop arm with the lateral notch, the wheel unit is held in a lifted position to enable the dual-purpose roller skate to function like an ordinary shoe for walking.

1 Claim, 5 Drawing Sheets

DUAL-PURPOSE ROLLER SKATE

BACKGROUND OF THE INVENTION

The present invention relates to a dual-purpose roller skate having two wheel units that could be shifted between a lowered and a lifted position for the roller skate to function like a normal roller skate or an ordinary shoe, respectively.

Skating is a popular exercise suitable for all ages, and in-line roller skates are particularly welcomed among people who love skating because they are superior to other exercises, such as jogging, bicycling, swimming, etc., in terms of their ability of enabling skaters to inspire more oxygen, strengthen muscles, and train to coordinate different body organs and areas during skating. Skating with in-line roller skates also causes less impact on the skaters' feet than jogging, and is therefore employed as a means of rehabilitation in curing athletic impairments.

The currently commercially available in-line roller skates are designed only for skating and could not be used as ordinary shoes for walking. A skater must take off the in-line roller skates to wear a pair of ordinary shoes when he or she is not in a skating rink or place suitable for skating. Thus, the skater always has to wear a pair of ordinary shoes and carry the in-line roller skates along with him or her to the skating rink. This is very inconvenient for the skater to do so.

SUMMARY OF THE INVENTION

A primary object of the present invention is to provide a dual-purpose roller skate that could be selectively used as a normal roller skate for skating or an ordinary shoe for walking simply by shifting its position adjustable wheel units into a lowered or a lifted position, respectively.

The position-adjustable wheel units for the dual-purpose roller skate of the present invention are separately fixedly mounted in open-bottomed cavities provided at a sole of the roller skate. Each of the wheel units mainly includes a base fixedly mounted to a top of the cavity, a wheel support pivotally connected to the base and being normally pushed downward by a first torsion spring, a wheel rotatably connected to the wheel support, and a stop arm pivotally connected at an end to one side of the base and having a bent free end normally pushed by a second torsion spring into engagement with a slot provided on the base. The bent end of the stop arm projected into the slot is also adapted to detachably engage with either a top or a lateral notch provided on the wheel support. By engaging the bent end of the stop arm with the top notch, the wheel unit is held in a lowered position to enable the dual-purpose roller skate to function like a normal roller skate for skating, and by engaging the bent end of the stop arm with the lateral notch, the wheel unit is held in a lifted position to enable the dual-purpose roller skate to function like an ordinary shoe for walking.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 3:
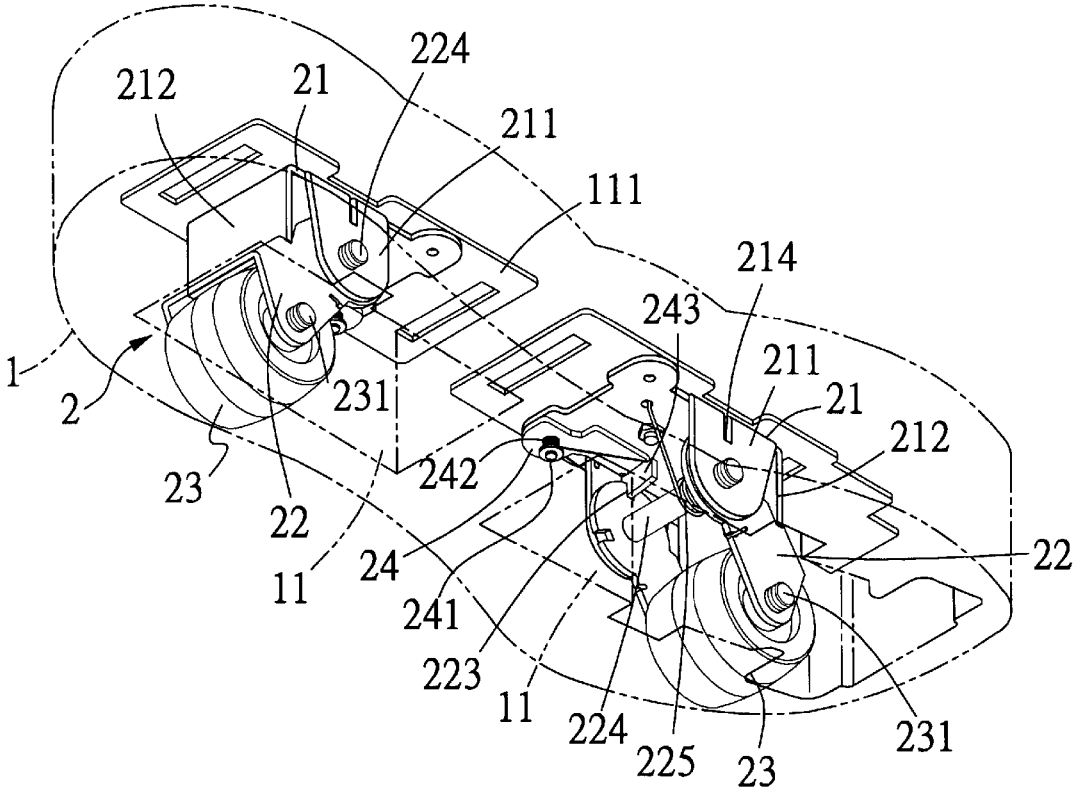
FIG. 3 is a fragmentary bottom perspective view of a dual-purpose roller skate of the present invention having two position-adjustable wheel units mounted to a sole of the roller skate.

Please refer to FIG. 3 that is a fragmentary bottom perspective view of a dual-purpose roller skate according to the present invention. The dual-purpose roller skate is characterized in a sole 1 that is provided near a front and a rear end with a front and a rear open-bottomed cavity 11, respectively, and two wheel units 2 that are separately fixedly mounted in the two cavities 11. Each wheel unit 2 is adjustable between a lowered and a lifted position. When the two wheel units 2 are in the lowered position, the dual-purpose roller skate is allowed to function like a normal roller skate for skating, and when the two wheel units 2 are in the lifted position, the dual-purpose roller skate is allowed to function like an ordinary shoe for walking.

The two wheel units 2 are symmetrically structured and mounted in the front and the rear cavities 11. Since these wheel units 2 operate in the same manner, only one of them will be described herein.

Figure 1:
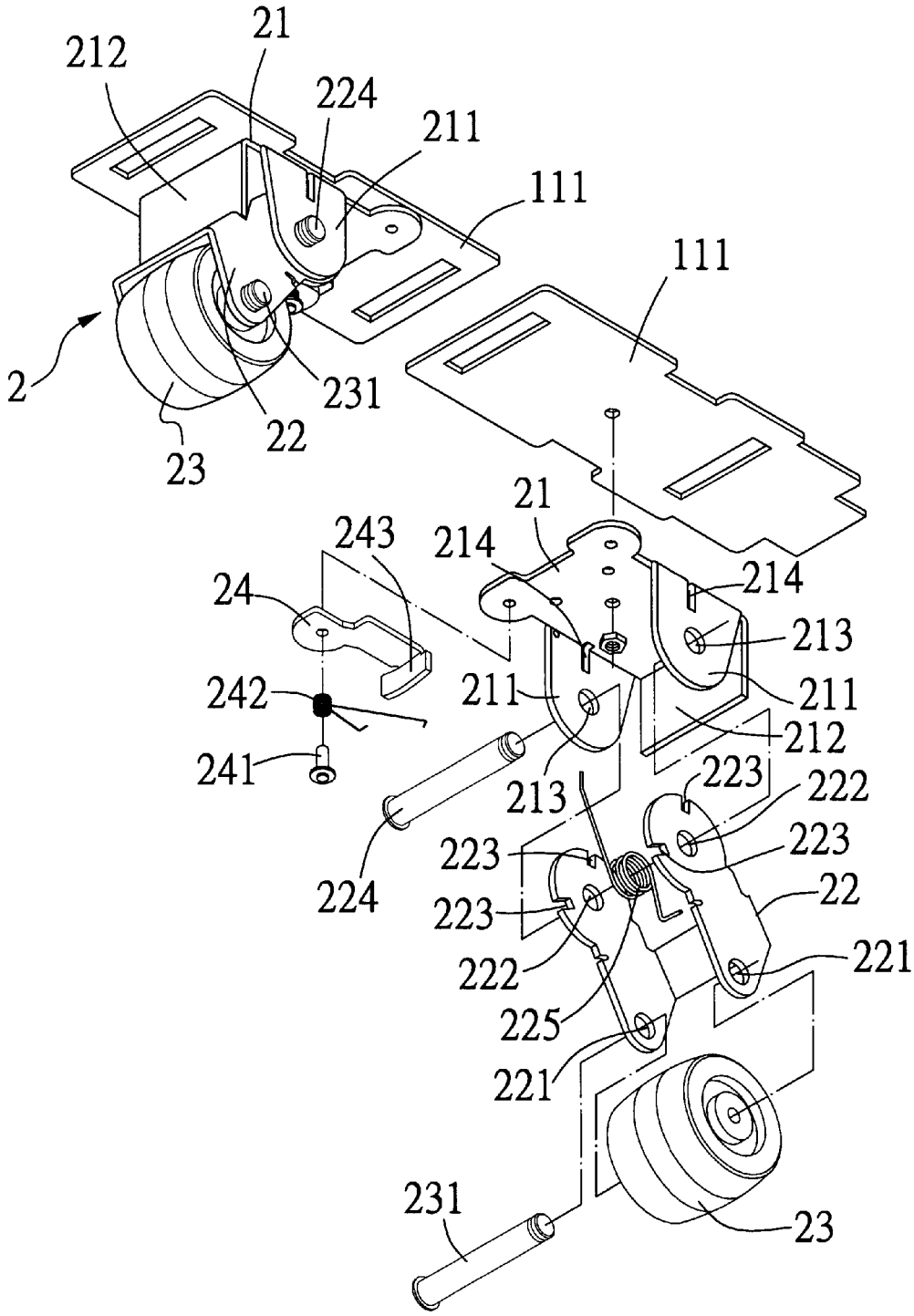
FIG. 1 is an exploded perspective view of a wheel unit for a dual-purpose roller skate according to the present invention.
Figure 2:
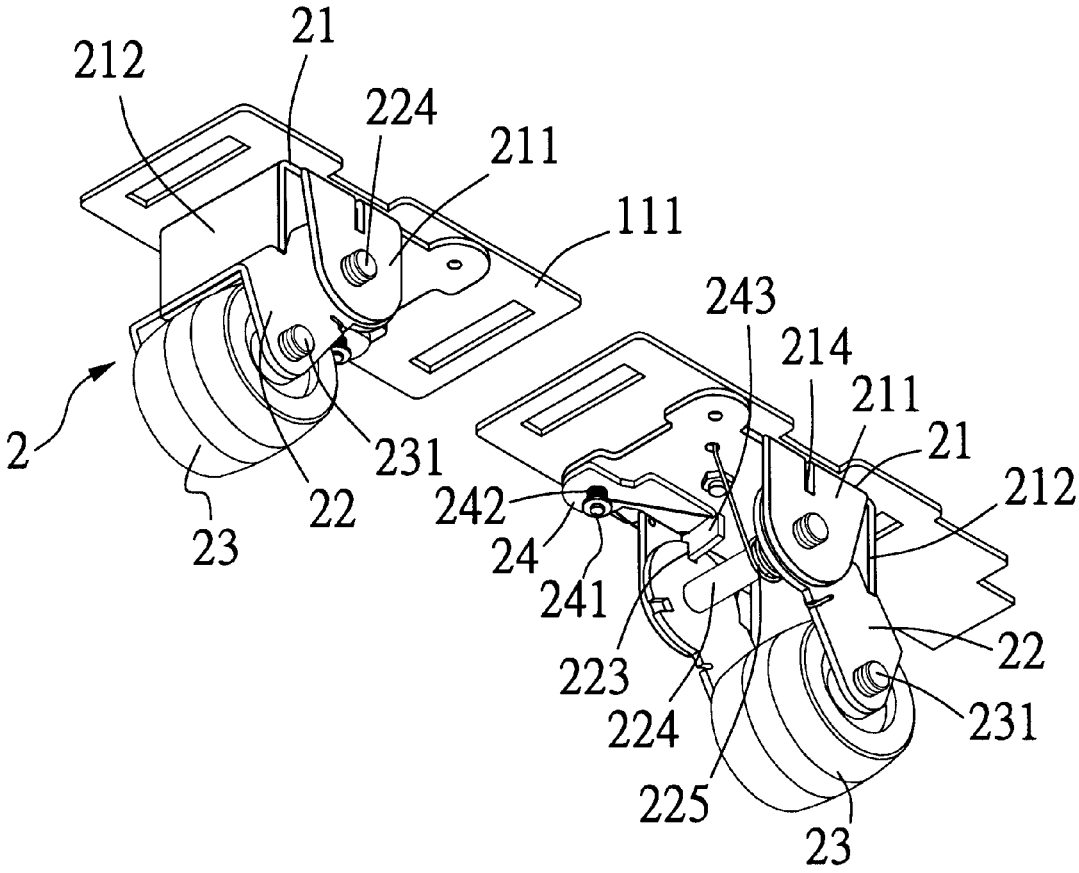
FIG. 2 is an assembled perspective view of FIG. 1.

Please refer to FIGS. 1, 2 and 3 at the same time. The wheel unit 2 includes a base 21, a wheel support 22, a wheel 23, and a stop arm 24.

The base 21 includes a horizontal portion, two vertical side plates 211 downward extended from two opposite sides of the horizontal portion, and a vertical stop plate 212 downward extended from an outer end of the horizontal portion. The side plates 211 are correspondingly provided at predetermined positions with a shaft hole 213 and a slot 214 above the shaft hole 213. The base 21 is screwed at the horizontal portion to a locating plate 111 fixedly mounted at a top of the cavity 11.

The wheel support 22 is a substantially U-shaped frame having two spaced arm portions that are correspondingly provided near a lower end with an axle hole 221, near an upper end with a shaft hole 222, and at an outer edge of the upper end with two spaced notches 223. One of the two notches 223 that is located near a top of each arm portion is referred to as a top notch 223 while the other is located at a lateral side of the upper end of the arm portion and is referred to as a lateral notch 223. The wheel support 22 is pivotally connected to the base 21 by extending a shaft 224 through the shaft holes 213 and 222 of the base 21 and the wheel support 22, respectively. A first torsion spring 225 is put around the shaft 224 to locate between the two arm portions of the wheel support 22 so as to normally push the wheel support 22 downward.

The wheel 23 is rotatably connected to the wheel support 22 to locate between the two arm portions by extending an axle 231 through the axle holes 221 of the wheel support 22 and the wheel 23.

The stop arm 24 is a long plate having a flat end and a downward bent end 243 opposite to the flat end. The stop arm 24 is pivotally connected at the flat end to an inner corner of the horizontal portion of the base 21 with a rivet 241. A second torsion spring 242 is put on the rivet 241 to locate between the rivet 241 and the stop arm 24 so as to normally push a laterally projected outer edge of the bent end 243 of the stop arm 24 into the slot 214 that is provided on one of the side plates 211 that is adjacent to the stop arm 24.

Figure 4:
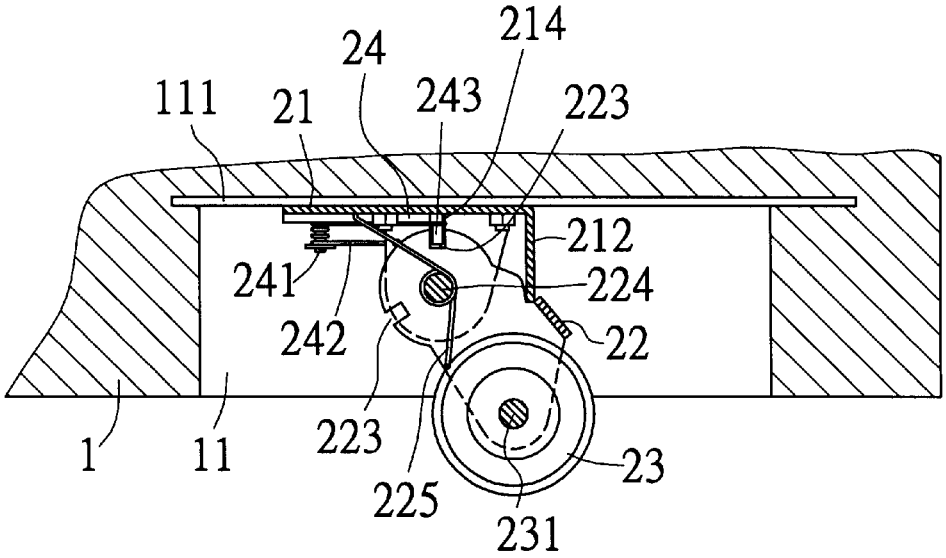
FIG. 4 is a fragmentary, sectioned side view of the roller skate of the present invention showing a wheel unit thereof is in a lowered position.
Figure 5:
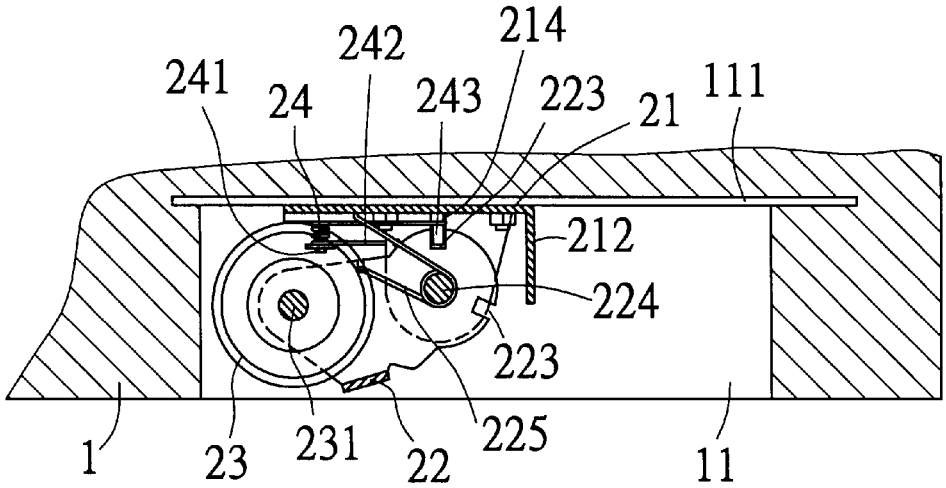
FIG. 5 is a fragmentary, sectioned side view of the roller skate of the present invention showing a wheel unit thereof is in a lifted position.

As can be seen in FIG. 3, the entire wheel unit 2 assembled from the above-mentioned components 21, 22, 23 and 24 in the above-described manner is securely connected to a bottom of a dual-purpose roller skate by screwing the base 21 to the locating plate 111 that is fixedly mounted to the top of the cavity 11 formed at a lower side of the sole 1. When the bent end 243 of the stop arm 24 is caused to engage with the top notch 223 on the wheel support 23, the wheel unit 22 is held to the lowered position with the wheel 23 downward exposed from the cavity 11, as shown in FIG. 4, allowing the dual-purpose roller skate to function like a normal roller skate for skating. And, when the bent end 243 of the stop arm 24 is caused to engage with the lateral notch 223 on the wheel support 23, the wheel unit 22 is held to the lifted position with the wheel 23 retracted into the cavity 11, as shown in FIG. 5, allowing the dual-purpose roller skate to function like an ordinary shoe for walking.

Figure 6:
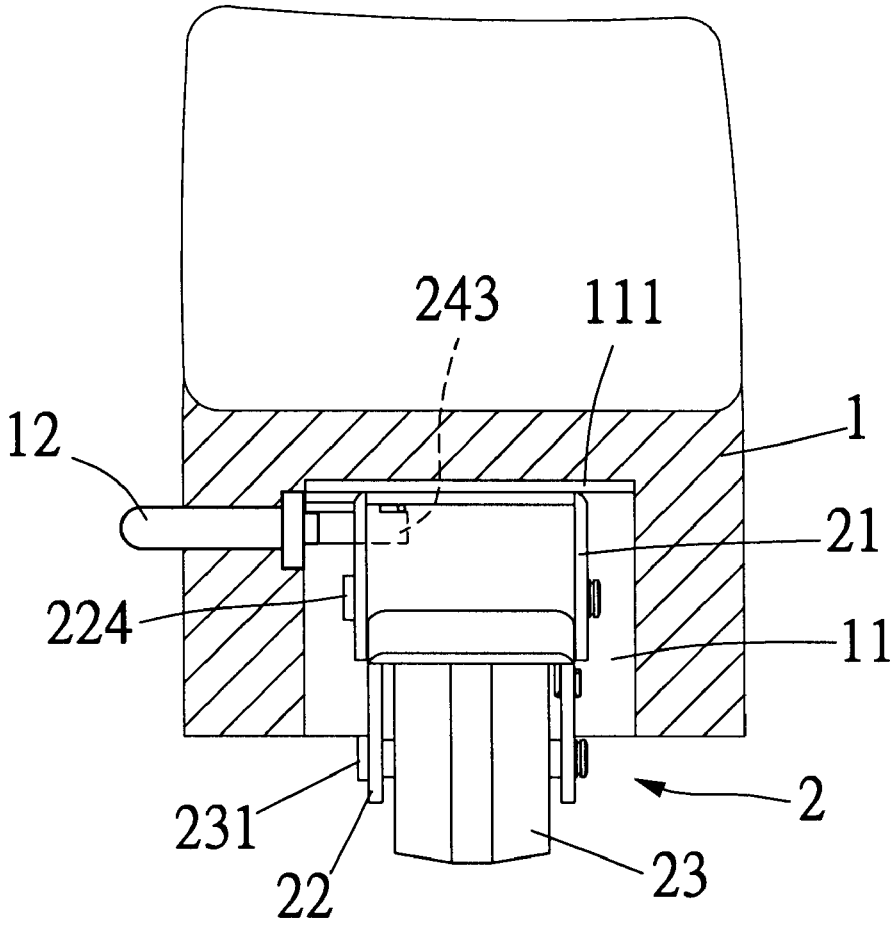
FIG. 6 is a fragmentary, sectioned front view of the roller skate of the present invention showing a stop arm for locating the wheel unit in place is manipulated via a release bar sideward projected from the sole of the roller skate.

To enable a wearer to conveniently and quickly engage the bent end 243 of the stop arm 24 with either the top or the lateral notch 223, a release bar 12 is provided for manipulating the stop arm 24 from outside of the sole 1. Please refer to FIG. 6. The release bar 12 is horizontally provided at one side of the sole 1 such that an inner end of the release bar 12 is extended into the cavity 11 to align with the slot 214 provided at the side plate 211 that is adjacent to the stop arm 24 and to normally press against the outer lateral edge of the bent end 243 that is outward extended through the same one slot 214. An outer end of the release bar 12 is projected from the sole 1 and can be easily accessed by a wearer with one finger. When the outer end of the release bar 12 is pushed inward relative to the sole 1, the inner end of the release bar 12 is brought to push the bent end 243 of the stop arm 24 inward to disengage the outer edge of the bent end 243 from the slot 214 and the notch 223. With the release bar 12 being held in the inward pushed position, the wearer may pivotally turn the wheel support 22 about the shaft 224 either to the lifted or the lowered position and then release the release bar 12. At this point, the second torsion spring 242 immediately pushes the bent end 243 toward the slot 214, so that the bent end 243 engages with another notch 223 with the outer side edge projected from the slot 214 again, securely holding the wheel support 22 in place.

When the wheel support 22 is in the lifted position to retract into the cavity 11, the engagement of the bent end 243 of the stop arm 24 with the slot 214 on the base 21 and the lateral notch 223 on the wheel support 22 effectively prevents the wheel support 22 from unexpected lowering to expose from the cavity 11. When the release bar 12 is pushed inward to disengage the bent end 243 from the lateral notch 223, the first torsion spring 225 immediately pushes the wheel support 22 downward to expose from the cavity 11. The wheel support 22 that is pushed by the first torsion spring 225 to the lowered position is finally stopped by a lower edge of the stop plate 212 of the base 21, as shown in FIG. 4, and therefore would not move into the cavity 11 due to an upward force applied on the wheel 23 during skating.

When the wearer wants to use the dual-purpose roller skate as an ordinary shoe, he or she needs only to push and hold the release bar 12 inward to disengage the bent end 243 of the stop arm 24 from the top notch 223 of the wheel support 22, and then use one hand to push the wheel support 22 into the cavity 11, and then release the release bar 12. At this point, the second torsion spring 242 immediately pushes the bent end 243 to engage with the lateral notch 223, so that the wheel support 22 is held in the lifted position and the wheel 23 is completely retracted into the cavity 11.

It is to be noted that the top and the lateral notches 223 on the wheel support 22 are so located and so spaced from each other that they always correspond to and engage with the bent end 243 of the stop arm 24 when the wheel support 22 is pivotally turned about the shaft 224 to its lowered or lifted position.

What is claimed is:

1. A dual-purpose roller skate comprising a sole that is provided near a front and a rear end with a front and a rear open-bottomed cavity, respectively, and two wheel units that are separately fixedly mounted in said front and said rear cavities and adapted to shift between a lowered position, in which said wheel units are exposed from said cavities for said dual-purpose roller skate to function like a normal roller skate for skating, and a lifted position, in which said wheel units are retracted into said cavities for said dual-purpose roller skate to function like an ordinary shoe for walking; each of said two wheel units comprising a base, a wheel support, a wheel, and a stop arm;

each said base including a horizontal portion, two vertical side plates downward extended from two opposite sides of said horizontal portion, and a vertical stop plate downward extended from an outer end of said horizontal portion, said side plates being correspondingly provided at predetermined positions with a shaft hole and a slot above said shaft hole, and each said base being screwed at said horizontal portion to a locating plate fixedly mounted at a top of each said cavity;

each said wheel support being a substantially U-shaped frame having two spaced arm portions that are correspondingly provided near a lower end with an axle hole, near an upper end with a shaft hole, and at a top and a lateral side of said upper end with a top notch and a lateral notch, respectively; said wheel support being pivotally connected to said base by extending a shaft through said shaft holes of said base and said wheel support; and a first torsion spring being put around said shaft to locate between said two arm portions of said wheel support so as to normally push said wheel support downward;

each said wheel being rotatably connected to said wheel support by extending an axle through said wheel and said axle holes of said wheel support; and said stop arm being a long plate having a flat end and a downward bent end opposite to said flat end, said stop arm being pivotally connected at said flat end to an inner corner of said horizontal portion of said base with a rivet, a second torsion spring being put on said rivet to locate between said rivet and said stop arm so as to normally push a laterally projected outer edge of said bent end into one of said slots that is provided on one of said side plates of said base that is adjacent to said stop arm, and said bent end of said stop arm projected into said slot being adapted to engage with either said top or said lateral notch on said wheel support;

whereby when said bent end of said stop arm is caused to disengage from said slot on said base and said top or said lateral notch on said wheel support, said wheel support could be pivotally turned about said shaft into either said lifted or said lowered position; and when said bent end of said stop arm is engaged with said lateral or said top notch on said wheel support and said slot on said base, said wheel unit and accordingly said wheel are securely held in said lifted or said lowered position for said dual-purpose roller skate to function like an ordinary shoe or a normal roller skate, respectively.

* * * * *